US007055423B2

(12) United States Patent
Stoll et al.

(10) Patent No.: US 7,055,423 B2
(45) Date of Patent: Jun. 6, 2006

(54) FLUID-ACTIVATED LINEAR DRIVE

(75) Inventors: Kurt Stoll, Esslingen (DE); Manfred Moritz, Plochingen (DE); Steffen Sailer, Metzingen (DE)

(73) Assignee: Festo AG & Co., Esslingen (DE)

( * ) Notice: Subject to any disclaimer, the term of this patent is extended or adjusted under 35 U.S.C. 154(b) by 20 days.

(21) Appl. No.: 10/502,238

(22) PCT Filed: Mar. 20, 2003

(86) PCT No.: PCT/EP03/02906

§ 371 (c)(1),
(2), (4) Date: Jul. 22, 2004

(87) PCT Pub. No.: WO03/085272

PCT Pub. Date: Oct. 16, 2003

(65) Prior Publication Data

US 2005/0066811 A1 Mar. 31, 2005

(30) Foreign Application Priority Data

Apr. 9, 2002 (DE) ..... 102 15 482

(51) Int. Cl.
*F15B 15/14* (2006.01)

(52) U.S. Cl. ..... 92/128; 92/169.1

(58) Field of Classification Search ..... 92/128, 92/169.1, 169.4, 171.1
See application file for complete search history.

(56) References Cited

U.S. PATENT DOCUMENTS

| | | | | |
|---|---|---|---|---|
| 5,440,183 | A * | 8/1995 | Denne | 310/12 |
| 5,514,961 | A | 5/1996 | Stroll et al. | |
| 6,308,614 | B1 | 10/2001 | Noda | |

FOREIGN PATENT DOCUMENTS

| | | |
|---|---|---|
| DE | 39 00 599 A1 | 7/1990 |
| EP | 0 621 408 A1 | 10/1994 |
| EP | 0 643 811 B1 | 3/1998 |
| JP | 50-143986 | 11/1975 |

* cited by examiner

*Primary Examiner*—Thomas E. Lazo
(74) *Attorney, Agent, or Firm*—Hoffman & Baron, LLP

(57) ABSTRACT

A fluid power linear drive has a drive housing (1) in which a housing chamber (4) is located containing at least one piston (5). The drive housing possesses two housing parts (2 and 3) placed alongside each other, which at mutually facing joint faces (16 and 17) are provided with half chambers (18*a* and 18*b*) constituted by elongated, groove-like recesses, which half chambers are united in a complementary fashion to form at least one housing chamber (4).

27 Claims, 5 Drawing Sheets

FLUID-ACTIVATED LINEAR DRIVE

CROSS-REFERENCE TO RELATED APPLICATIONS

This application claims priority based on an International Application filed under the Patent Cooperation Treaty, PCT/EP03/02906, filed on Mar. 20, 2003, and German Patent Application No. DE 102 15 482.1, filed on Apr. 9, 2002.

FIELD OF THE INVENTION

The invention relates to a fluid power linear drive comprising a drive housing, in which at least one housing chamber is located having a linear extent, in which at least one linearly movable piston is placed, said piston being kinematically coupled with a force output part having at least one force output section accessible from outside the drive housing.

BACKGROUND OF THE INVENTION

Fluid power linear drives of this type are known in many different designs, attention being called for instance to the U.S. Pat. No. 5,514,961. As a rule linear drives possess an elongated drive housing, which is composed of a tubular middle part and terminally arranged end plates, the middle part defining a cylindrical housing chamber, in which a piston is accommodated able to be linearly moved by fluid actuation. The movement of the piston is available as an output force outside the drive housing at an output section, which is on a piston rod kinematically coupled with the piston.

Known linear drives suffer from the disadvantage that there are certain limitations as regards economizing in the costs of production there is a certain limit. This applies to a particular degree for designs which to meet increasing demands for integration of customers are fitted with operationally specific functional elements, as for example sensor means or valve means.

SUMMARY OF THE INVENTION

It is accordingly one object of the present invention to provide a fluid power linear drive, which renders possible adaptable production in a cost saving fashion.

In order to achieve this object in the case of a fluid power linear drive of the type initially mentioned there is a provision such that the drive housing possesses two housing parts placed together alongside each other, which at the mutually facing joint faces are provided with half chambers constituted by elongated groove-like recesses, such half chambers being complementary to each other to form the at least one housing chamber.

Thus the housing chamber accommodating the at least one piston is composed of two half chambers defining half of the periphery, such chambers being formed prior to assembly of the two housing parts at the joint faces. Since the joint faces are readily accessible prior to the assembly of the housing parts it is possible, by having a suitable design of the half chambers, to arrive at the desired configuration of the housing chamber by a corresponding design of the half chambers. There is furthermore the possibility, by having a suitable configuration of the mutually opposite joint faces, of designing accommodating chambers for fluid ducts, necessary for the operation of the linear drive, electrical conductor channels or to accommodate functional elements so that a linear drive is produced having an extremely high degree of integration. For instance, valve means serving for control and sensor means employed for indicating positions may be accommodated in the joint region so that an extremely compact arrangement is produced, which is also provides for optimum protection for the above mentioned components. It is particularly advantageous when the structure in accordance with the invention is employed in connection with housing parts consisting of plastic, since in this case by injection molding for example or by foaming various different structures and furthermore complex cavity designs are possible in the joint region which are extremely adaptable and economic.

Advantageous further developments of the invention will appear from the dependent claims.

If a gap-free transition can be ensured between the peripheral walls of the half chambers, it is possible for the running face for the piston to be directly constituted by the wall of the housing chamber. Alternatively however a separate running sleeve of stainless steel may be inserted into the housing chamber, which defines the running face for the piston. Such a running sleeve may be a simple tube body able to be manufactured in simple and economic manner with a high degree of precision.

Preferably the linear drive is designed in the form of a piston rod linear drive, that is to say it represents a so-called drive cylinder in the case of which the external force output takes place at one piston rod at least which protrudes from drive housing.

Although it would in principle be possible to have the end termination of the housing chamber in the form of separate cover elements, there are manufacturing advantages to be gained if the end terminal walls are respectively constituted by the two joined housing parts. The passage opening rendering possible the passage of any piston rod present is preferably, like the design of the housing chambers, constituted by two complementary passage opening halves on the facing joint faces of the two housing parts.

In the joint region of the two housing parts it is preferred to have one or more cavities defined by the two housing parts, which if desired may serve various quite different purposes. Thus the cavities, more particularly in the case of an elongated design, function as fluid ducts and/or channels for electrical conductors. Moreover, accommodating chambers may be defined, in which valve means and/or sensor means or other operationally relevant functional components are placed. In the case of the other functional components it is for instance a question of electronic component, as for example as a component of electrical control circuitry or of indicating optical means for visualizing certain operational states of the linear drive.

If large cavity cross sections are required it is preferred to provide the cavities by having oppositely placed recesses at the two joint faces, which constitute complementary pairs. If on the contrary only relatively small cross sectional dimensions are necessary, for example to provide for fluid ducts or channels for electrical conductors, it is convenient to form a suitably shaped groove-like recess at one joint face, which is covered over by a region, which is not recessed, in the other housing part, placed on it, like a lid or cover.

To the extent that valves placed in cavities, provided for this purpose, are present, it may be a question of valves which are initially in a functional state, and which are inserted like cartridges in the respective cavity. Alternatively there may be a provision such that the two housing parts directly constitute the housing of at least one valve so that in the corresponding cavity only the functional components of the valve have to be inserted. A similar design of a control valve is admittedly disclosed in the European patent publication 0 643 311 B1, but the latter does not mention the integration into the drive housing of a linear drive, in the case of which one and the same housing parts constitute both the drive housing and also at least one valve housing.

The configuration of the housing parts of the drive housing may be orientated in accordance with the respective purpose of use. Thus for example attachment means may be provided on the outer face, which allow the attachment of the linear drive itself or the attachment of additional components, as for example sensors or valves. A particularly compact structure, also needing only a minimum amount of material, is possible, if the two housing parts are respectively in the form of hollow shells at least at the half chambers defining the housing chamber.

In accordance with the principle of the invention linear drives may be produced, which comprise a plurality of drive units each containing one housing chamber with an associated piston. It is in this manner that it is possible to produce so-called tandem drives.

The precise fitting together of the housing parts on assembly of the drive housing is simplified if positioning means is provided on the joint faces, which connect with each other in an interlocking manner. It is a question in this case more particularly of projections and recesses which are complementary to each other.

In the following the invention will be explained with reference to the accompanying drawings.

DESCRIPTION OF THE PREFERRED EMBODIMENTS

Figure 5:
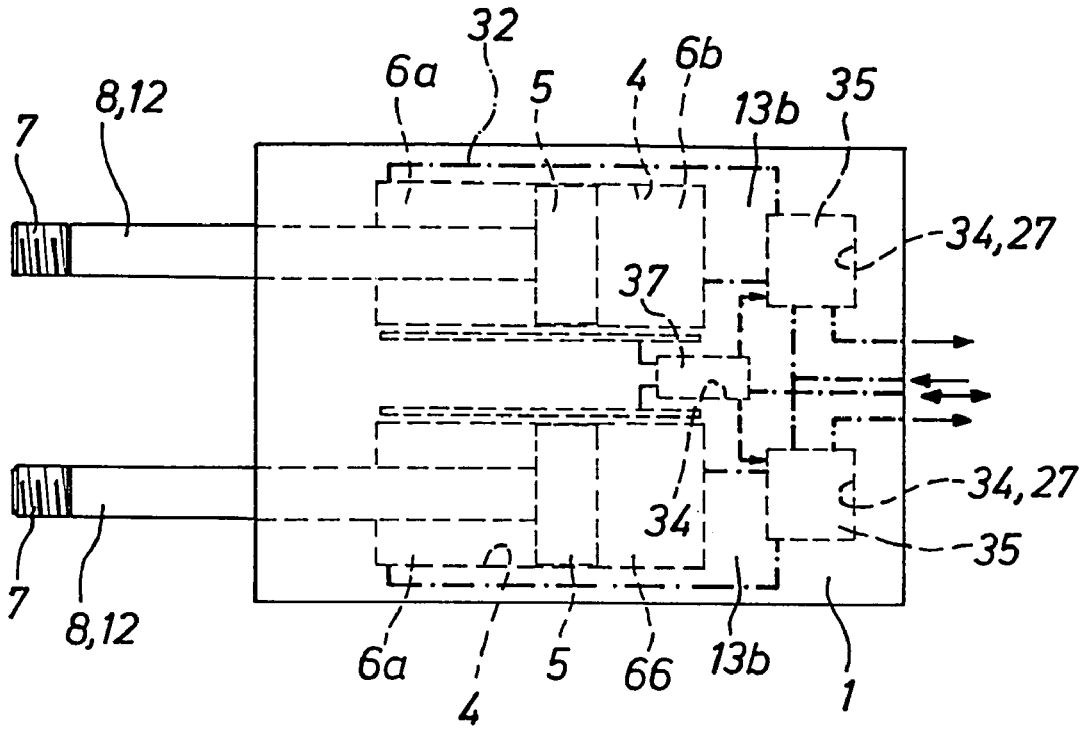
FIG. 5 is a diagrammatic representation of a further possible structure of the linear drive.

Firstly a description of the completely assembled fluid power linear drive will be presented, which is illustrated on the one hand in FIGS. 1 through 4 and in FIG. 5 on the other hand in two possible embodiments.

The linear drive comprises a drive housing 1, which is composed of two elongated housing parts placed alongside each other and firmly connected together, which in the following will be referred to as the first housing part 2 and as the second housing part 3. In the interior of the drive housing 1 at least one housing chamber 4 having a longitudinal extent, is provided, FIGS. 1 through 4 indicating a design with one housing chamber and FIG. 5 illustrating a design with two parallel adjacently placed housing chambers 4. In all working examples the housing chamber 4, is cylindrical and preferably circularly cylindrical in its configuration.

In each housing chamber there is a piston adapted 5 to move in the longitudinal direction. The piston 5 divides up the housing chamber 4 axially into two working spaces, which in the following will be termed the first working space 6*a* and the second working space 6*b*. The working spaces are able to be pressurized in a controlled manner by a fluid pressure medium, more particularly compressed air, in order to drive the piston 5 in a longitudinal movement or to position it at certain points.

The linear motion of the piston 5 can be transmitted at a force output section 7, accessible outside the drive housing, of a force output part 8 kinematically coupled with the respective piston 5. The linear drives of the working example are linear drives having piston rods—also referred to as a fluid power cylinder—whose force output part 8 is constituted by a piston rod 12, which extends through a terminal wall 13*a* on the housing and terminates the first working space 6*a*. The first terminal wall 13*a* is, like the oppositely arranged terminal wall 13*b* at the end of the second working space 6*b*, preferably an integral component of the drive housing 1. On its way to the outside the piston rod 12 extends through a passage opening 14 placed coaxially in front of the housing chamber 4, near the first terminal wall 13*a*.

The linear drive could also be in the form of a piston rod-less linear drive. Furthermore, in each housing chamber 4 a plurality of axially following pistons could be arranged.

The two housing parts 2 and 3 are laterally placed together in a joint portion 15, a first joint face 16 of the first housing part 2 coming to abut against a second joint face 17 of the second housing part 3.

In each joint face 16 and 17 an elongated groove-like recess is formed to constitute a first and, respectively, a second half chamber 18*a* and 18*b*. In the state placed together of the two housing parts 2 and 3 the two identically shaped half chambers 18*a* and 18*b* are opposite to each other at the same level so that they complement each other to form the respective housing chamber 4. In the case of a circularly cylindrical housing chamber 4 each half chamber 18*a* and 18*b* will have the form of a cylinder which is cut into two halves at its mid point.

In a similar manner the passage opening 14 for the piston rod 12 is constituted by two mutually complementary passage openings 22*a* and 22*b*, which are formed axially adjoining the respective half chamber 18*a* and 18*b* in the associated joint face 16 and 17.

During the production of the linear drive the two housing parts 2 and 3 are preferably manufactured of plastic using plastic processing technology, the half chambers 18*a* and 18*b* and the halves 22*a* and 22*b* of the passage openings being produced directly during molding. In the case of a large production batch manufacture will be by casting and more especially by injection molding. In the case of medium batches it will involve foamed plastic technology. In the case of extremely small batches shaping the plastic will preferably by so-called "rapid prototyping". The plastic employed may be reinforced by embedded glass fibers and/or metal particles.

After the two housing parts 2 and 3 have been produced in the right form, they are placed alongside each other in the fashion indicated and firmly joined together. The firm connection is in this case preferably produced by bonding or by welding at the joint faces. Accordingly it is possible to do without additional sealing means placed between the joint faces 16 and 17. The weld may for example be produced by laser beam welding or by ultrasonic welding.

Prior to the fitting together of the two housing parts 2 and 3 however the piston 5 with the piston rod 12 is placed in the drive housing. In the working embodiment illustrated in FIG. 5 the running face for the piston 5 is constituted directly by the wall of the housing chamber 4 accommodating it. Such a design is characterized by a particularly small number of components, although it is to be recommended only in the case of high precision joining of the housing parts 2 and 3 so that at the transitions between the peripheral wall sections of the half chambers 18*a* and 18*b* there are no joint gaps, which might later give rise to leaks. In the working embodiment illustrated in FIGS. 1 through 4 the running face for the piston 5 is the inner face of a bearing bushing 23 separately inserted into the housing chamber 4. This bushing 23 is therefore placed coaxially between the piston 5 and the peripheral wall of the housing chamber 4.

The bearing bushing 23 is a simply manufactured tubular body, which is more particularly made of stainless steel and possesses superior quality running properties. Accordingly, low friction sliding movement of the piston 5 engaging its inner face is ensured.

In the case of the use of an additional bushing 23 additional sealing means should be provided, which prevent leakage of fluid between the two working spaces 6*a* and 6*b* around the bushing 23. In the working embodiment the bushing 23 is surrounded at each terminal region by an annular seal 24, which is effective between the outer periphery of the bushing 23 and the inner periphery of the housing chamber 4.

The bushing 23 is preferably installed with the seals 24 already on it in the drive housing 1.

For guiding the piston rod 12 a bearing bushing 21 is inserted in the passage opening 14 to coaxially surround the piston rod 12. Furthermore, a bushing 21 is inserted in the passage opening 14 to coaxially surround the piston rod 12. In addition annular sealing and/or stripping means 25 are placed in the passage opening 14 to coaxially surround the piston rod 12.

The above mentioned components to be installed in the drive housing 1 are preferably placed on one and the same housing part 2 (in this case the first housing part) prior to assembly of the two housing parts 2 and 3. Then the second housing part 3, without parts fitted on it, only needs to be mounted in position as a sort of cover, the sections (projecting past the first joint face 16) of the components (installed on the other housing part 2) extending into the matching recesses in the second joint face 17.

In order to ensure an exactly positioned assembly of the two housing parts 2 and 3, on the two joint face 16 and 17 mutually complementary first and second positioning means 26*a* and 26*b* are provided, which in the assembled state of the two housing parts 2 and 3 fit in an interlocking manner into one another. Preferably it is a question of mutually interlocking projections and recesses. The positioning means 26*a* and 26*b* prevent relative movement of the housing parts 2 and 3 in the joint plane. Preferably the positioning means 26*a* and 26*b* are produced while making the original model of the housing parts 2 and 3.

In the assembled state of the two housing parts 2 and 3 in the case of the working embodiment there are further cavities 27 in the joint region 15 jointly defined by the two housing parts 2 and 3. Same result partly from mutually correspondingly placed complementary recesses 28*a* and 28*b* at the two joint faces 16 and 17 and partly from recesses 31*a* and 31*b* formed in the one joint face 16, such recesses 31*a* being only covered by the non-recessed regions 31*b* of the other joint face 17.

The recesses 31*a* which are only covered over, are in the working example groove-like in configuration and serve to produce fluid ducts 32 and channels 33 for electrical conductors. The cavities 27 delimited by the pairs of recesses are in the working example in the form of accommodating chambers 34 for electrical valve means 35 for the control of the linear drive and for sensor means 36 responsive to the operational state of the linear drive.

Figure 3:
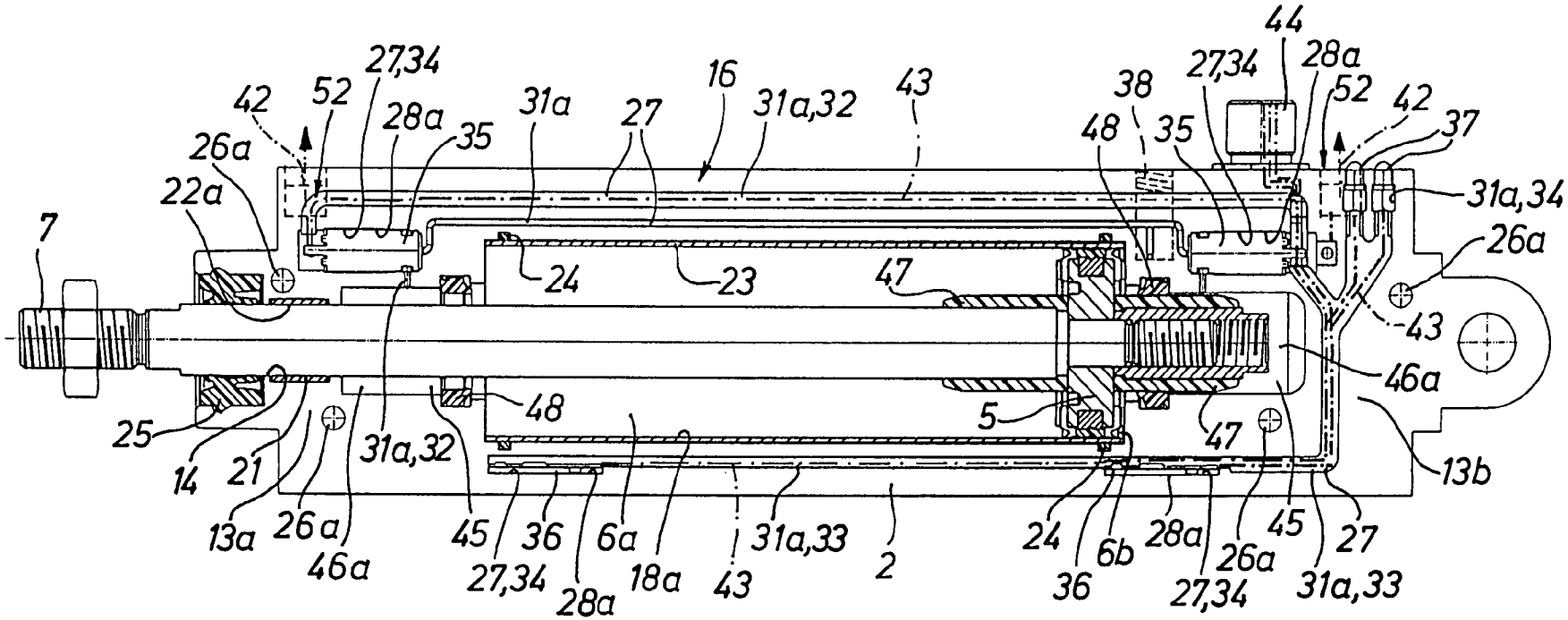
FIG. 3 is a plan view of the joint face of the one housing part fitted with components, looking in a direction as indicated by the arrow III in FIG. 2.
Figure 4:
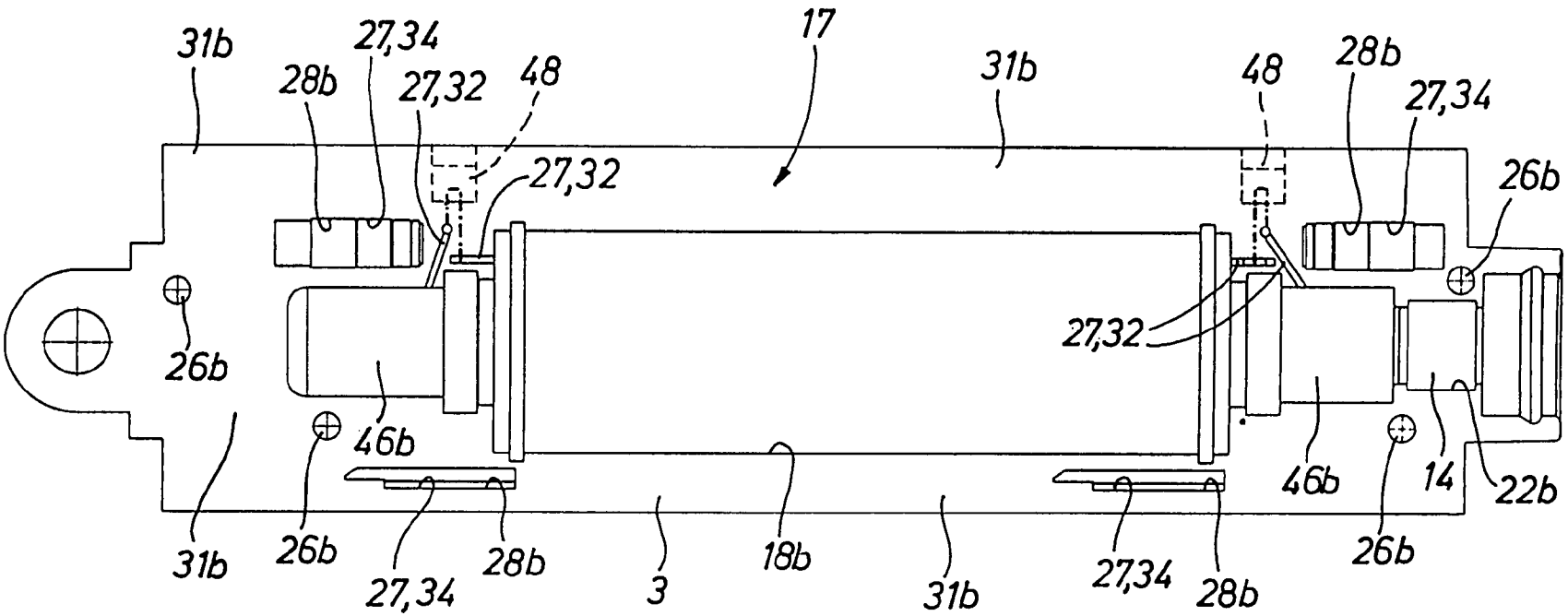
FIG. 4 is a plan view of the joint face of the other housing part looking in the direction indicated by the arrow IV in FIG. 2.

The sensor means 36 are designed in a fashion dependent on the parameters to be sensed. In the working embodiment it is a question of position sensor means, for instance in the form of so-called cylinder switches or of a displacement measurement system. As shown in FIGS. 3 and 5, the accommodating chambers 34 for the sensor means 36 are preferably alongside the corresponding housing chamber 4.

In the manner indicated any further functionally relevant cavities may be provided in the joint portion 15. Simply as an example FIG. 3 shows accommodating chambers 34, provided adjacent to the second terminal wall 13, for functional components 37 in the form of optical indicating means, which provide a light signal at predetermined positions of the piston. In FIG. 5 a accommodating chamber 34 for functional components 37 is illustrated, the functional components 37 comprising electronic components, which may define electronic control circuitry and/or a field bus station.

Such fluid ducts 32 include ducts which connect a connection opening 38 or a venting opening 42, provided on the outer face of the drive housing 1, selectively and on the basis of received control signals with the two working spaces 6*a* and 6*b*. Arranged on these fluid ducts 32 there are electrical valve means 35 which are able, on the basis of electrical control signals received, to connect the respectively associated working space 6*a* or, respectively, 6*b* selectively with the connection opening 38 or with a venting opening 42. In this case it is for example a question of control valves with a 3/2 valve functionality. The valve means 35 may, in accordance with FIGS. 1 through 4, be switch valve means or however also be a continuous characteristic valve, as is the case with the linear drive of FIG. 5.

In the case of the linear drive of FIG. 5 the accommodating chambers 34 for the valve means 35 are located on the rear side, opposite to the piston rod 12, of the respectively, corresponding housing chamber 4 in the second terminal wall 13 provided here. Accordingly despite a plurality of drive units in a mutually parallel arrangement, a relatively slim structure is made possible.

Figure 1:
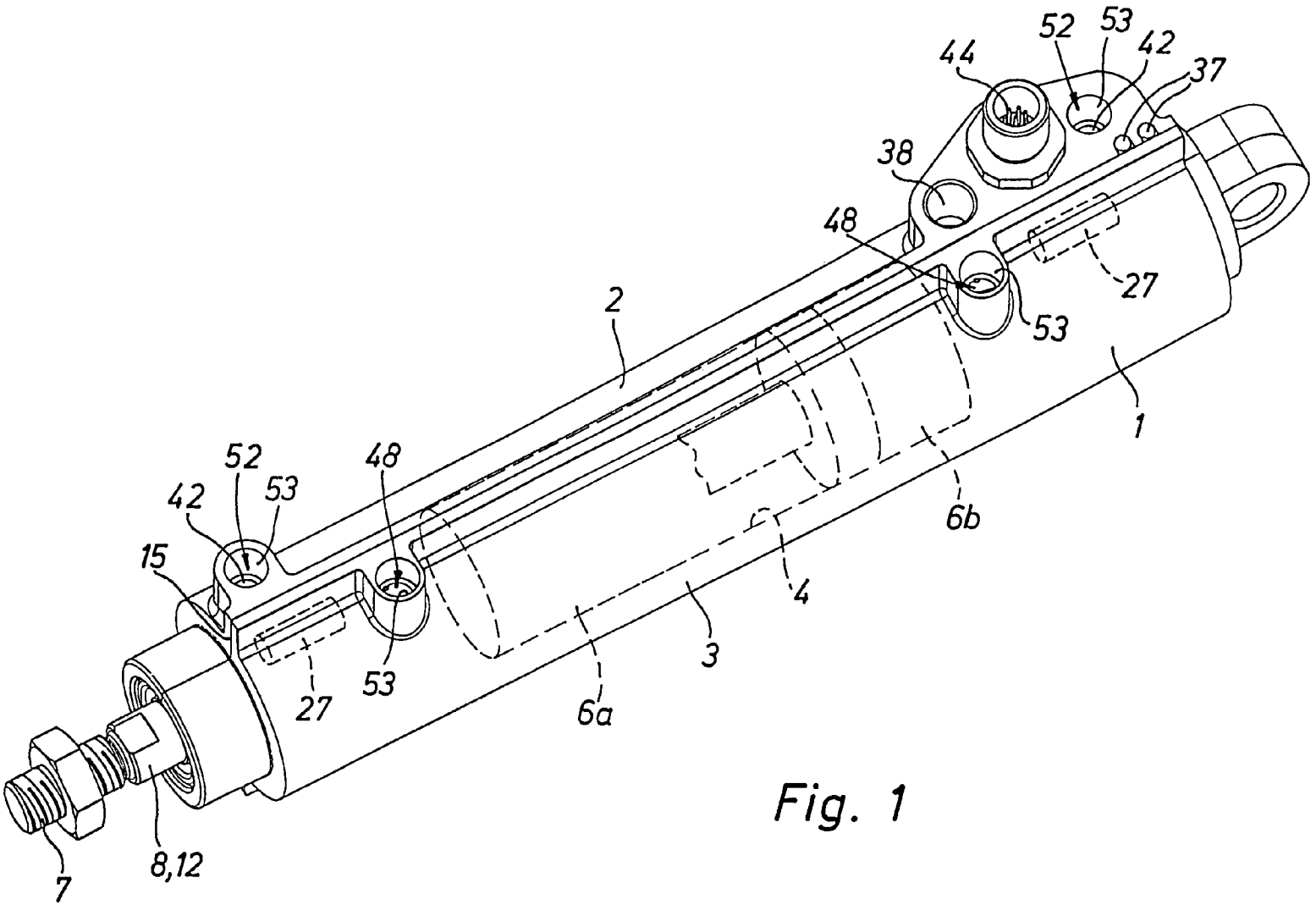
FIG. 1 shows a preferred design of the linear drive in a perspective view.
Figure 2:
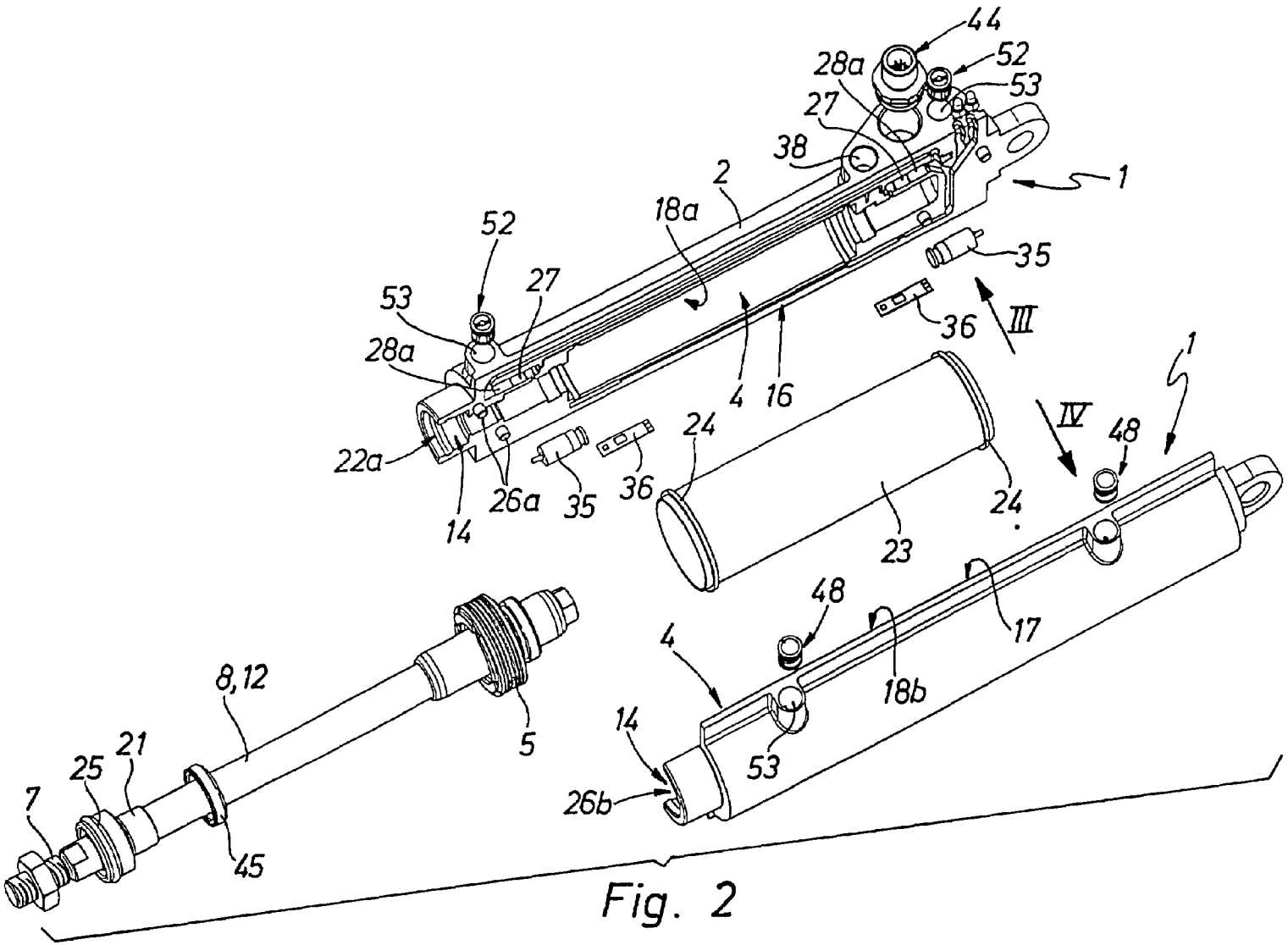
FIG. 2 illustrates the linear drive in accordance with FIG. 1 in an exploded showing.

There will be a particularly small requirement for the housing parts 2 and 3 as regards material, if at least at the half chambers 18*a* and 18*b* the housing parts are designed in the form of half shells as is clearly illustrated in FIG. 2. In this case there is a relatively thin walled drive housing 1 along at least a major part of the periphery of the housing chamber 4.

In the working embodiment illustrated in FIGS. 1 through 4 valve means 35 are employed, in the case of which it is a question of a generally self-contained valve, which would be capable of functioning outside the accommodating chamber for them and which is placed like a cartridge in the respective accommodating chamber 34. These valve means 35 each have a respective valve housing.

Departing from this arrangement FIG. 5 indicates that structures are also possible, in the case of which the valve housing of the valve means 35 is directly constituted by the drive housing 1. In the accommodating chambers 34 delimited by the drive housing 1 merely the functional components of the respective valve are located without a separate valve housing. The design may be the same as that described in the European patent 0 643 811 B1.

In the above mentioned electrical conductor channels 33 the electrical conductors 43 are laid which serve for the electrical connection of the sensor means 36, the valve means 35 and any other electrical functional components. Preferably they run to a common electromechanical connection means 44 side of the drive housing 1, at which a cable leading to an external electronic control means (not illustrated in detail) may be connected.

Damping chambers 45 may be arranged axially in relation to the housing chambers 4, such damping chambers being composed of chamber halves in pairs in the two joint faces 16 and 17. Same render possible a pneumatic terminal damping function for the piston 5, which is at either end provided with a damping piston 47 able to plunge into the associated damping chamber 45. On entering the damping chamber 45 the otherwise present exit path for the pressure medium is shut off owing to cooperation with an annular seal 48 so that such pressure medium can only flow out through fluid ducts 32, in which an adjustable choke means 48 is placed.

In addition to the choke means 48 responsible for terminal damping it is also possible to provide speed regulating choke means 52, which are placed upstream of the venting openings 42.

In the working example both choke means 48 and 52 are arranged in accommodating recesses 53 formed in the housing parts 2 and 3, such recesses 53 being able to be placed at any suitable position on the drive housing. Preferably they are on the same side of the drive housing 1.

The description so far will make it clear that the measures in accordance with the invention make possible the design of a linear drive, in the case of which all functional components employed for the electrical and fluid control of the linear drive may be integrated in the drive housing 1. The longitudinal division of the drive housing in this respect opens up the possibility of creating the space for the accommodation of at least one part of the functional components in a relatively problem-free manner at the readily accessible joint faces 16 and 17.

All recesses in the joint faces 16 and 17 and preferably furthermore the other accommodating recesses and/or channels are preferably formed directly on shaping the housing parts 2 and 3.

On fitting the drive housing 1 together the procedure is more particularly such that before assembly all components to be installed in the joint region 15 are exclusively placed in one of the housing parts so that after this the housing part, not having components mounted on it, may be placed on top.

In order to operate the finished linear drive it is sufficient, in the case of the working example, to provide an electrical and a pneumatic connection. Further measures are not necessary.

It will be clear that any attachment means required may be molded externally on the two housing parts 2 and 3 in order to attach components required for operation, as for example further sensor means for the ascertainment of intermediate positions.

The invention claimed is:

1. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein the running face for the piston is constituted by a bearing bushing inserted in the housing chamber, such bushing consisting of metal.

2. The linear drive as set forth in claim 1, wherein the bushing is provided on the outer periphery with a surrounding seal for sealing engagement with the wall of the housing chamber.

3. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein the linear drive is designed in the form of a piston rod linear drive and wherein the force output part is in the form of a piston rod connected with the piston, such rod projecting through a passage opening, such opening being placed in front of the housing chamber axially, the passage opening being constituted by two mutually complementary passage opening halves on the mutually facing joint faces at the two housing parts.

4. The linear drive as set forth in claim 3, wherein at least one of a bearing bushing and an annular sealing and stripping means for the piston rod are arranged in the passage opening.

5. The linear drive as set forth in claim 3, wherein the housing parts, at least adjacent to their half chambers defining the housing chamber are respectively in the form of half shells.

6. The linear drive as set forth in claim 3, wherein the two housing parts are bonded or welded at their joint faces.

7. The linear drive as set forth in claim 3, wherein the running face for the piston is directly constituted by the wall of the housing chamber.

8. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein terminal position damping chambers are arranged as an axial extension of the housing chamber for terminal damping of the piston, such chambers being constituted by damping chamber halves, which fit together in a complementary fashion, in the mutually facing joint faces of the two housing parts.

9. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein one or more respective jointly delimited cavities are formed in a joint region of the two housing parts, the cavities being provided as fluid ducts and/or as electrical conductor channels and/or as accommodating chambers for valve means and/or for sensor means and/or for other functional components for the operation of the linear drive.

10. The linear drive as set forth in claim 9, wherein mutually facing recesses are provided for the formation of one or more of the cavities, the mutually facing recesses being complementary in a paired manner, on the two joint faces of the housing parts.

11. The linear drive as set forth in claim 9, wherein a recess formed in the joint face of the one housing part is covered over by a non-recessed region of the joint face of the other housing part for the formation of one or more of the cavities.

12. The linear drive as set forth in claim 9, wherein the fluid ducts constituted by one or more cavities extend between the two working spaces separated in the housing chamber by the piston and at least one connection opening provided on the outer face of the drive housing.

13. The linear drive as set forth in claim 9, wherein electrical conductor channels constituted by one or more cavities extend between cavities serving as accommodating chambers for electrically operated valve means and at least one electromechanical connection means.

14. The linear drive as set forth in claim 9, wherein the two housing parts directly also constitute the housing of at least one valve, whose functional components are arranged in an accommodating chamber formed by at least one of the one or more cavities.

15. The linear drive as set forth in claim 9, wherein cartridge-like valve means are placed in the at least one cavity.

16. The linear drive as set forth in claim 9, wherein valve means are provided, the valve means defining at least one switch valve and/or at least one valve with a continuous characteristic.

17. The linear drive as set forth in claim 9, wherein, in the case of one piston provided with a piston rod, at least one accommodating chamber for the accommodation of valve means is provided on the rear side, opposite to the piston rod of the housing chamber.

18. The linear drive as set forth in claim 9, wherein the sensor means accommodated in one or more of the cavities are in the form of pressure sensor means and/or position sensor means.

19. The linear drive as set forth in claim 9, wherein the at least one chamber provided to accommodate sensor means is arranged in the joint region of the housing parts alongside the housing chamber.

20. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein a plurality of housing chambers are defined in a joint region of the drive housing, the housing chambers being placed alongside each other and respectively provided with at least one piston.

21. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein the two housing parts consist of plastic.

22. The linear drive as set forth in claim 21, wherein the two housing parts are in the form of plastic castings.

23. The linear drive as set forth in claim 21, wherein the two housing parts are in the form of foamed plastic components.

24. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein the two terminal end walls of the at least one housing chamber are directly formed by the two housing parts placed on each other.

25. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein electronic control circuitry is arranged on or in the drive housing.

26. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein all functional components employed for the electrical-fluidic control of the linear drive is integrated in the drive housing.

27. A fluid power linear drive comprising a drive housing, in which at least one housing chamber is located having a linear extent, in which at least one linearly movable piston is placed, said piston being kinematically coupled with a force output part having at least one force output section accessible from outside the drive housing, wherein the drive housing possesses two housing parts placed together alongside each other, which at mutually facing joint faces are provided with half chambers constituted by elongated groove-like recesses, such half chambers being complementary to each other to form the at least one housing chamber, wherein position securing means are provided on the joint faces of the two housing parts, the position securing means being in interlocking engagement with each other.

* * * * *